US010257891B2

(12) United States Patent
Kang et al.

(10) Patent No.: US 10,257,891 B2
(45) Date of Patent: Apr. 9, 2019

(54) MICROWAVE OVEN

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Jeonhong Kang, Foshan (CN); Minghua Hong, Foshan (CN); Guohua Li, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 734 days.

(21) Appl. No.: 14/922,923

(22) Filed: Oct. 26, 2015

(65) Prior Publication Data

US 2016/0119982 A1 Apr. 28, 2016

(30) Foreign Application Priority Data

Oct. 27, 2014 (CN) ..... 2014 1 0588708

(51) Int. Cl.
*H05B 6/64* (2006.01)
*H05B 6/80* (2006.01)
*F24C 15/20* (2006.01)

(52) U.S. Cl.
CPC ..... *H05B 6/6423* (2013.01)

(58) Field of Classification Search
CPC ..... H05B 6/6423; F24C 15/20
USPC ..... 219/757, 756, 681, 400; 126/21 A, 126/299 D, 299 R, 273 A
See application file for complete search history.

(56) References Cited

U.S. PATENT DOCUMENTS 4,418,261 A * 11/1983 Jailor ..... H05B 6/6423 126/21 A
2003/0218012 A1* 11/2003 Kim ..... F24C 15/2042 219/757
2008/0156792 A1* 7/2008 Song ..... F24C 15/20 219/757
2008/0156796 A1 7/2008 Song et al.

FOREIGN PATENT DOCUMENTS

| | | |
|---|---|---|
| CN | 1351242 | 5/2002 |
| CN | 101307918 | 11/2008 |
| CN | 102128458 | 7/2011 |
| CN | 203837048 | 9/2014 |
| CN | 204240424 | 4/2015 |
| JP | 2006329496 | 12/2006 |

* cited by examiner

*Primary Examiner* — Quang T Van
(74) *Attorney, Agent, or Firm* — Hodgson Russ LLP

(57) ABSTRACT

A microwave oven includes a housing having a receiving chamber therein. An inner case is provided in the receiving chamber. A left air channel is formed between a left side wall of the receiving chamber and a left side of the inner case, a right air channel is formed between a right side wall of the receiving chamber and a right side of the inner case. Respective fans are provided in the left and right air channels, each of the left and right fans including a front impeller, a rear impeller and a driving motor. At least one of the front and rear impellers is adjacent to at least one of front and rear walls of the receiving chamber which is corresponding thereto, at least one of the front and rear impellers is spaced from the driving motor at a predetermined distance.

17 Claims, 4 Drawing Sheets

MICROWAVE OVEN

RELATED APPLICATION

This U.S. application claims priority and benefits of prior Chinese Patent Application No. 201410588708.3, filed with State Intellectual Property Office on Oct. 27, 2014. The entire contents of the before-mentioned patent application are incorporated by reference as part of the disclosure of this U.S. application.

FIELD

The present invention relates to a microwave oven.

BACKGROUND

The existing ventilation microwave ovens with double exhaust fans has disadvantages such as high resistance of air or exhaust fumes suction and less amount of air or exhaust fumes suction.

SUMMARY

Embodiments of the present invention seek to solve at least one of the problems existing in the related art to at least some extent. Accordingly, embodiments of the present invention provide a microwave oven, which overcomes the shortages of high resistance of air or exhaust fumes suction and less amount of air or exhaust fumes suction for existing ventilation microwave ovens with double exhaust fans.

For the ventilation microwave ovens with double exhaust fans in the related arts, the air with exhaust fumes is sucked from the air inlet provided at the bottom plate, a part of the air with exhaust fumes is moved toward the front plate and is sucked from the front end of the fan, another part of the air with exhaust fumes is moved toward the rear plate and is sucked from the rear end of the fan. Since two parts of the air with exhaust fumes are moved oppositely, the air with exhaust fumes is required to turn the direction to enter into the fan, so that the moving path thereof is long which causes high resistance of air or exhaust fumes suction and less amount of air or exhaust fumes suction.

Moreover, the ventilation microwave oven is installed within the cabinet, and there is a limitation for the depth of the cabinet. Since the air inlet of the fan is required to space from both the front plate and the rear plate at a certain distance, the distance between the first front air inlet of the fan and the front plate and the distance between the first rear air inlet and the rear plate are short, so that a large pressure is generated to the fan, which causes the air suction amount is small. In order to ensure the air suction amount, although the rotating speed of the fan can be increased, the noise is correspondingly increased.

It is an object for the present invention to solve at least one of technique problem in the related arts in a certain extent. Thus, the present invention provides a microwave oven with advantages such as high efficiency for air suction, high efficiency for exhaust fumes suction, lower noise and good cooling effect.

The microwave oven according to one embodiment of the present invention includes: a housing having a receiving chamber therein, a left air inlet and a right air inlet being provided at a bottom portion of the housing and an air outlet being provided in the housing; an inner case provided in said receiving chamber, a left air channel being formed between a left side wall of said receiving chamber and a left side of said inner case and being in communication with said left air inlet and said air outlet of the housing, a right air channel being formed between a right side wall of said receiving chamber and a right side of said inner case and being in communication with said right air inlet and said air outlet of the housing; and a left fan and a right fan, said left fan being provided in the left air channel and said right fan being provided in the right air channel, the left fan and the right fan each including a front impeller, a rear impeller and a driving motor, wherein at least one of the front impeller and the rear impeller is adjacent to at least one of a front wall and a rear wall of said receiving chamber which is corresponding thereto, said at least one of the front impeller and the rear impeller is spaced from the driving motor at a predetermined distance.

The microwave oven according to the embodiment of the present invention has advantages such as high efficiency for air suction, high efficiency for exhaust fumes suction, low noise, good cooling effect and so on.

Furthermore, the microwave oven according to above embodiment in the present invention may have following technique features:

According to one embodiment in the present invention, said front impeller is spaced from said front wall of the receiving chamber at a first predetermined distance, said rear impeller is adjacent to said rear wall of the receiving chamber, said rear impeller is spaced from said driving motor at a second predetermined distance, wherein a first front air inlet is provided in a front end surface of the front impeller, and a first rear air inlet is provided in a rear end surface of the front impeller, a second front air inlet is provided in a front end surface of the rear impeller.

According to one embodiment in the present invention, said left air inlet and said right air inlet are adjacent to said front wall of the receiving chamber.

According to one embodiment in the present invention, said front impeller is adjacent to the front all of the receiving chamber, said front impeller is spaced from said driving motor at a third predetermined distance, said rear impeller is spaced from said rear wall of the receiving chamber at a fourth predetermined distance, wherein a first rear air inlet is provided in a rear end surface of the front impeller, a second front air inlet is provided in a front end surface of the rear impeller, and a second rear air inlet is provided in a rear end surface of the rear impeller.

According to one embodiment in the present invention, said left air inlet and said right air inlet are adjacent to the rear wall of said receiving chamber.

According to one embodiment in the present invention, said front impeller is adjacent to the front wall of said receiving chamber, said front impeller is spaced from said driving motor at a fifth predetermined distance, said rear impeller is adjacent to the rear wall of said receiving chamber, said rear impeller is spaced from said driving motor at a sixth predetermined distance, wherein a first rear air inlet is provided in a rear end surface of the front impeller, and a second front air inlet is provided in a front end surface of the rear impeller.

According to one embodiment in the present invention, said left air inlet and said right air inlet are located in the middle of the bottom portion of the receiving chamber, said left air inlet and said right air inlet are faced to the first rear air inlet of the front impeller and the second front air inlet of the rear impeller.

According to one embodiment in the present invention, said fifth predetermined distance is equal to said sixth predetermined distance.

According to one embodiment in the present invention, said housing includes a bottom plate, an top plate, and a front plate, a rear plate, a left side plate and a right side plate which are provided on said bottom plate and said top plate, wherein the left air inlet and the right air inlet of the housing are provided in said bottom plate, said air outlet of the housing is provided in at least one of said top plate, said front plate and said rear plate.

BRIEF DESCRIPTION OF THE DRAWINGS

These and other aspects and advantages of embodiments of the present disclosure will become apparent and more readily appreciated from the following descriptions made with reference to the accompanying drawings, in which.

Figure 1:
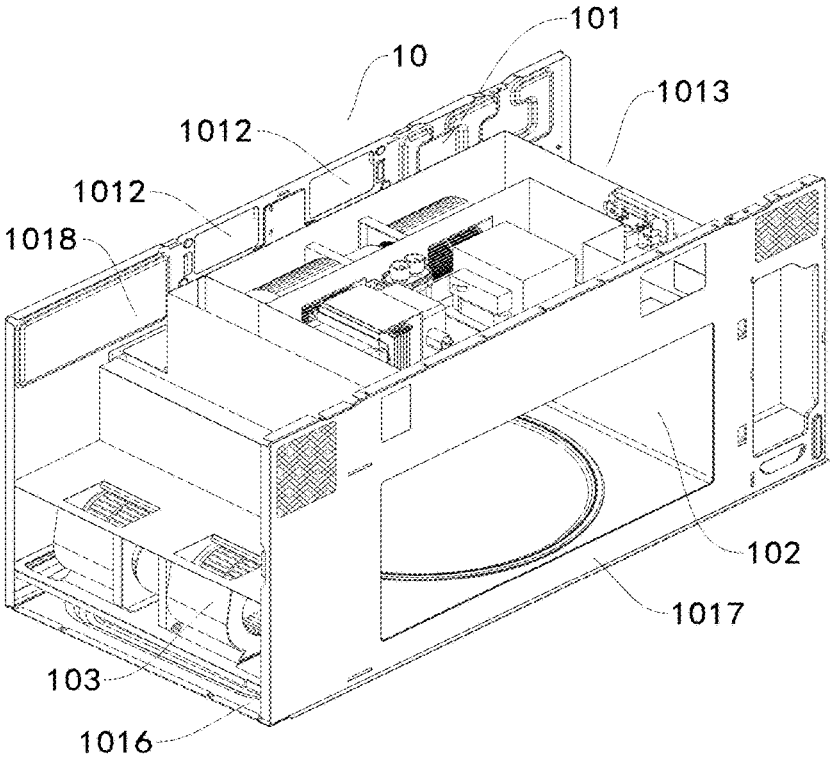
FIG. 1 is a structural schematic view of the microwave oven according to an embodiment of the present invention.

REFERENCE NUMERALS microwave oven: 10 housing: 101, left air inlet: 1011, air outlet: 1012, receiving chamber: 1013, front wall: 1014, rear wall: 1015, bottom plate: 1016, front plate: 1017, rear plate: 1018, inner case: 102, left fan: 103, front impeller: 1031, first front air inlet 10311, first rear air inlet 10312, rear impeller 1032, second front air inlet 10321, second rear air inlet 10322, driving motor 1033.

DETAILED DESCRIPTION

Preferred embodiments of the present invention will be described hereinafter in detail with reference to the attached drawings. The present invention may, however, be embodied in many different forms and should not be construed as being limited to the embodiments set forth herein; rather, these embodiments are provided so that the present invention will be thorough and complete, and will fully convey the concept of the invention to those skilled in the art.

Now the microwave oven 10 according to an embodiment of the present invention is described with reference to the accompany drawings. As shown in FIGS. 1-7, the microwave oven 10 according to the embodiment of the present invention comprises a housing 101, an inner case 102, a left fan 103 and a right fan (not shown).

A receiving chamber 1013 is provided inside the housing 101, a left air inlet 1011 and a right air inlet is provided at the bottom portion of the housing 101, and an air outlet 1012 is provided in the housing 101. The inner case 102 is provided inside the receiving chamber 1013. A left air channel communicated with the left air inlet 1011 and the air outlet 1012 of the housing 101 is formed between the left side wall of the receiving chamber 1013 and the left side of the inner case 102, and a right air channel communicated with right air inlet and the air outlet 1012 of the housing 101 is formed between the right side wall of the receiving chamber 1013 and the right side of the inner case 102.

A left fan 103 is provided inside the left air channel, and a right fan is provided inside the right air channel. The left fan 103 and the right fan each has a front impeller 1031, a rear impeller 1032 and a driving motor 1033. Wherein at least one of the front impeller 1031 and the rear impeller 1032 is adjacent to the at least corresponding one of the front wall 1014 and the rear wall 1015 of the receiving chamber 1013, and said at least one of the front impeller 1031 and the rear impeller 1032 is spaced from the driving motor at a predetermined distance.

The microwave oven 10 according to the embodiment of the present invention allows that, after the air with exhaust fumes enters from the left air inlet 1011 and the right air inlet, moving direction of the air with exhaust fumes does not to be changed by neighboring at least one of the front impeller 1031 and the rear impeller 1032 to at least corresponding one of the front wall 1014 and the rear wall 1015 of the receiving chamber 1013 and spacing said at least one of the front impeller 1031 and the rear impeller 1032 from the driving motor 1033 at a predetermined distance, so as to greatly reduce the exhausting path of the air with exhaust fumes. Therefore, the air suction efficiency of the left fan 103 and the right fan is extremely improved without changing the distance between the front plate and the rear plate of the microwave oven 10, thus the efficiency of sucking the exhaust fumes for the microwave oven 10 is greatly improved.

Since the air suction efficiency for the left fan 103 and the right fan is high, the rotating speed thereof can be reduced, and then the noise of the microwave oven 10 is reduced.

Furthermore, since at least one of the front impeller 1031 and the rear impeller 1032 is spaced from the driving motor 1033 at a predetermined distance, the air amount passing through the driving motor 1033 is extremely improved, so as to greatly improve the cooling effect for the driving motor 1033.

Therefore, the microwave oven 10 according to the embodiment of the present invention has advantages such as high efficiency of the air suction, high efficiency of the exhaust fumes suction, low noise, good cooling effect and so on.

Particularly, the microwave oven 10 according to the embodiment of the present invention may be a ventilation microwave oven.

As shown in FIG. 1, the housing 101 includes a bottom plate 1016, a top plate, and a front plate 1017, a rear plate 1018, a left side plate and a right side plate which are provided on the bottom plate 1016 and the top plate. Wherein, the left air inlet 1011 and the right air inlet of the housing 101 are provided in the bottom plate 1016, and the air outlet 1012 of the housing 101 is provided in at least one of the top plate, the front plate 1017 and the rear plate 1018.

Figure 2:
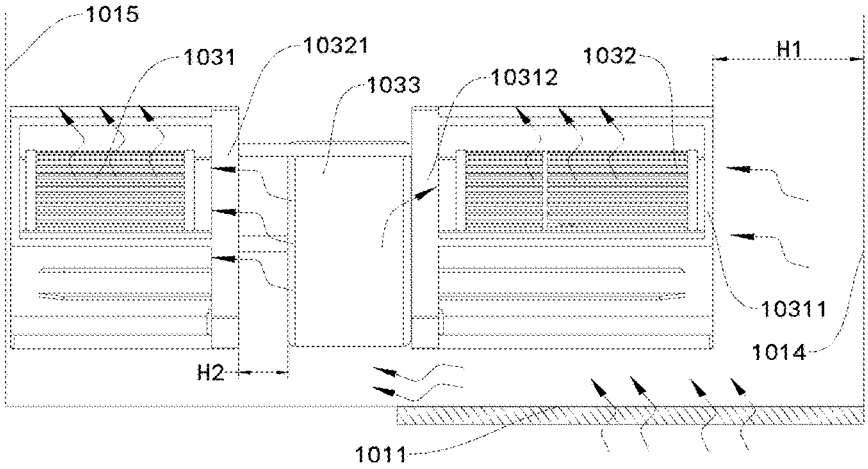
FIG. 2 is a partial structural schematic view of the microwave oven according to one embodiment of the present invention.
Figure 3:
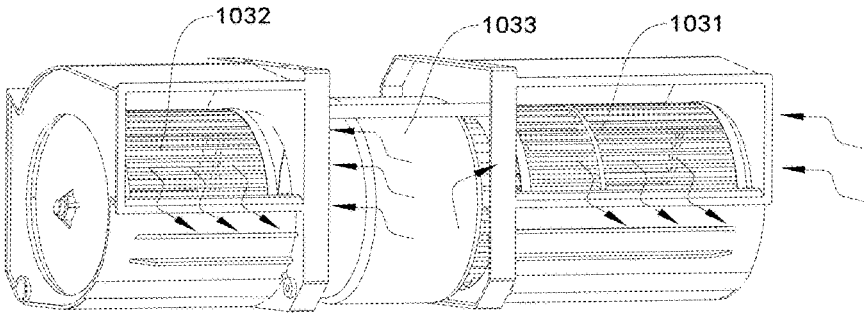
FIG. 3 is a structural schematic view of the left fan of the microwave oven according to one embodiment of the present invention.

In the first embodiment of the present invention, as shown in FIGS. 2 and 3, the front impeller 1031 is spaced from the front wall 1014 of the receiving chamber at a first predetermined distance H1, the rear impeller 1032 is adjacent to the rear wall 1015 of the receiving chamber 1013, and the rear impeller 1032 is spaced from the driving motor 1033 at a second predetermined distance H2. That is, comparing with the existing microwave oven, the distance between the rear impeller 1032 and the driving motor 1033 is increased.

Preferably, a first front air inlet 10311 is provided in the front end surface of the front impeller 1031, a first rear air inlet 10312 is provided in the rear end surface of the front impeller 1031, and a second front air inlet 10321 is provided in the front end surface of the rear impeller 1032. That is, there is no air intake provided in the rear end surface of the rear impeller 1032, all of the air (wind) for the rear impeller 1032 is entered into the second front air inlet 10321 of the rear impeller 1032. Most of the air for the front impeller 1031 is sucked into the first front air inlet 10311 of the front impeller 1031, and a small part of the air thereof is sucked into the first rear air inlet 10312 of the front impeller 1031.

After the air with exhaust fumes enters from the left air inlet 1011 and the right air inlet, a part of the air with exhaust fumes is sucked by the first front air inlet 10311 of the front impeller 1031. The remaining air with exhaust fumes is moved backwardly and separately sucked by the first rear air inlet 10312 of the front impeller and the second front air inlet 10321 of the rear impeller 1032. That is, the air with exhaust fumes is moved backwardly from the front. Therefore, the moving direction of the air with exhaust fumes does not need to be changed so as to greatly reduce the exhausting path of the air with exhaust fumes. Thus, the air suction efficiency of the left fan 103 and the right fan is extremely improved without changing the distance between the front plate and the rear plate of the microwave oven 10, so that the efficiency of sucking the exhaust fumes for the microwave oven 10 is greatly improved.

Furthermore, since there is a larger distance between the rear impeller 1032 and the driving motor 1033, more air with exhaust fumes can be passed though the driving motor, so that the cooling effect for the driving motor 1033 is extremely improved. That is, the driving motor 1033 can be cooled down by the air sucked from the second front air inlet 10321 of the rear impeller 1032. Furthermore, the driving motor 1033 also can be cooled down by the air sucked from the first rear air inlet 10312 of the front impeller 1031.

Advantageously, the left air inlet 1011 and the right air inlet are adjacent to the front wall 1014 of the receiving chamber 1013. That is, the left air inlet 1011 and the right air inlet are closed to the front edge of the bottom plate 1016. Thus, it allows the air with exhaust fumes to move backwardly from the front, so the moving direction of the air does not need to be changed so as to greatly reduce the exhausting path of the air with exhaust fumes. Thus, the air suction efficiency of the left fan 103 and the right fan is extremely improved without changing the distance between the front plate and the rear plate of the microwave oven 10, so that the efficiency of sucking the exhaust fumes for the microwave oven 10 is greatly improved.

Figure 4:
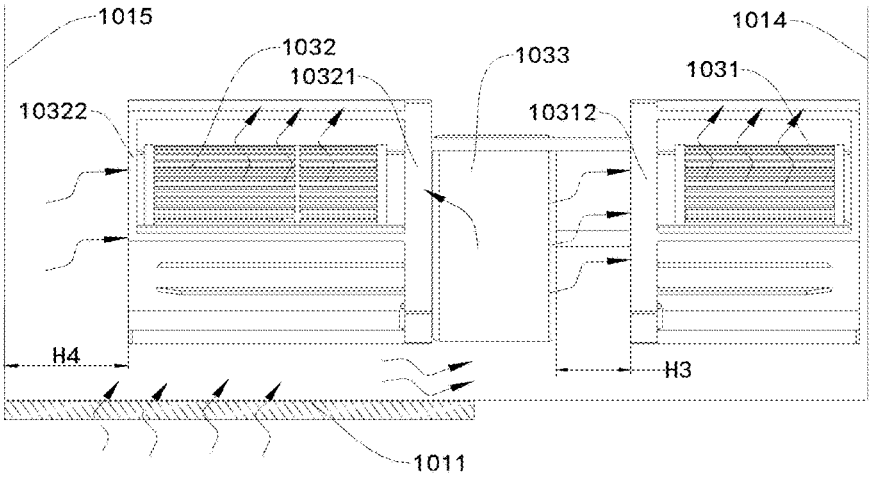
FIG. 4 is a partial structural schematic view of the microwave oven according to another embodiment of the present invention.
Figure 5:
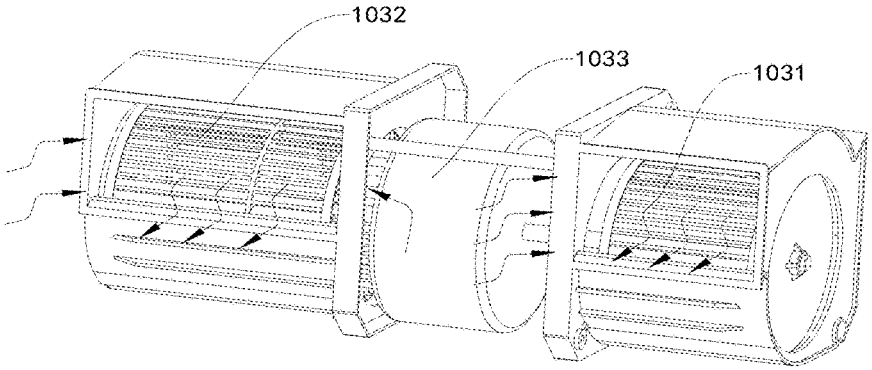
FIG. 5 is a structural schematic view of the left fan of the microwave oven according to another embodiment of the present invention.

As shown in FIGS. 4 and 5, in the second embodiment of the present invention, the front impeller 1031 is adjacent to the front wall 1014 of the receiving chamber 1013, and the front impeller 1031 is spaced from the driving motor 1033 at a predetermined distance H3. That is, comparing with the existing microwave oven, the distance between the front impeller 1031 and the driving motor 1033 is increased. The rear impeller 1032 is spaced from the rear wall 1015 of the receiving chamber 1013 at a predetermined distance H4.

Preferably, the first rear air inlet 10312 is provided in the rear end surface of the front impeller 1031, the second front air inlet 10321 is provided in the front end surface of the rear impeller 1032, and a second rear air inlet 10322 is provided in the rear end surface of the rear impeller 1032. In other words, there is no air inlet provided in the front end surface of the front impeller 1031, that is, all of the wind for the front impeller 1031 is entered from the first rear air inlet 10312 of the front impeller 1031. Most of the wind for the rear impeller 1032 is sucked by the second rear air inlet 10322 of the rear impeller 1032, and a small part of the wind therefor is sucked by the second front air inlet 10321 of the rear impeller 1032.

After the air with exhaust fumes enters from the left air inlet 1011 and the right air inlet, a small part of the wind is sucked from the second rear air inlet 10322 of the rear impeller 1032. The remaining air with exhaust fumes moves forwardly and is separately sucked from the first rear air inlet 10312 of the front impeller 1031 and the second front air inlet 10321 of the rear impeller 1032. That is, the air with exhaust fumes is moved forwardly from the back, so the moving direction of the air does not need to be changed so as to greatly reduce the exhausting path of the air with exhaust fumes. Thus, the air suction efficiency of the left fan 103 and the right fan is extremely improved without changing the distance between the front plate and the rear plate of the microwave oven 10, so that the efficiency of sucking the exhaust fumes for the microwave oven 10 is greatly improved.

Furthermore, since there is a larger distance between the front impeller 1031 and the driving motor 1033, more air with exhaust fumes can be passed though the driving motor, so that the cooling effect for the driving motor 1033 is extremely improved. That is, the driving motor 1033 can be cooled down by the air sucked from the first rear air inlet 10312 of the front impeller 1031. Furthermore, the driving motor 1033 also can be cooled down by the air sucked from the second front air inlet 10321 of the rear impeller 1032.

Advantageously, the left air inlet 1011 and the right air inlet are adjacent to the rear wall 1015 of the receiving chamber 1013. In other words, the left air inlet 1011 and the right air inlet are closed to the rear edge of the bottom plate 1016. Thus, it allows the air with exhaust fumes to move forwardly from the back, so the moving direction of the air does not need to be changed so as to greatly reduce the exhausting path of the air with exhaust fumes. Thus, the air suction efficiency of the left fan 103 and the right fan is extremely improved without changing the distance between the front plate and the rear plate of the microwave oven 10, then the efficiency of sucking the exhaust fumes for the microwave oven 10 is greatly improved.

Figure 6:
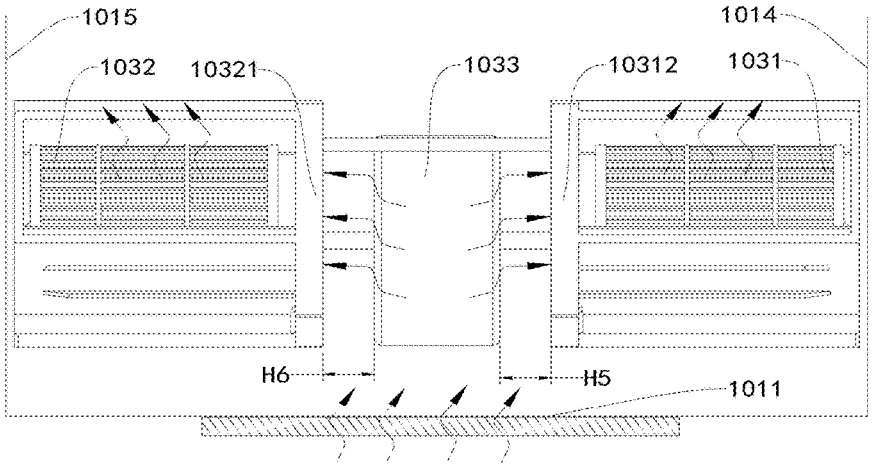
FIG. 6 is a partial structural schematic view of the microwave oven according to yet another embodiment of the present invention.
Figure 7:
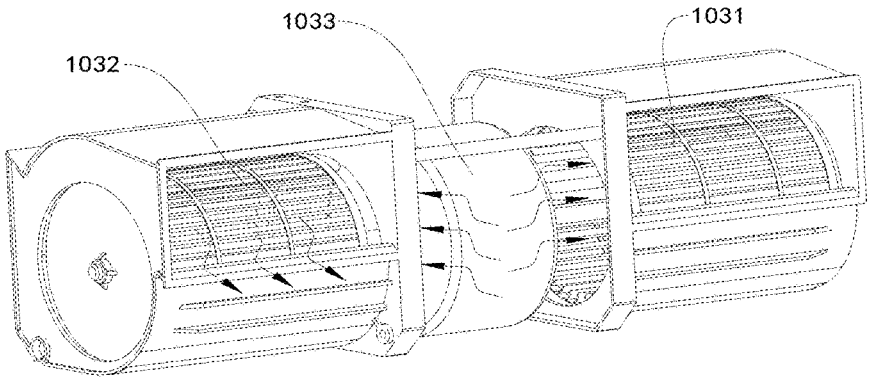
FIG. 7 is a structural schematic view of the left fan of the microwave oven according to yet another embodiment of the present invention.

As shown in FIGS. 6 and 7, in the third embodiment of the present invention, the front impeller 1031 is adjacent to the front wall 1014 of the receiving chamber 1013, and the front impeller 1031 is spaced from the driving motor 1033 at a predetermined distance H5. The rear impeller 1032 is adjacent to the rear wall 1015 of the receiving chamber, and the rear impeller 1032 is spaced from the driving motor 1033 at a sixth predetermined distance H6. In other words, comparing with the existing microwave oven, the distance between the front impeller 1031 and the driving motor 1033 and the distance between the rear impeller 1032 and the driving motor 1033 are increased.

Preferably, the first rear air inlet 10312 is provided in the rear end surface of the front impeller 1031, the second front air inlet 10321 is provided in the front end surface of the rear impeller 1032. That is, there is no air inlet provided in the front end surface of the front impeller 1031, all of the wind for the front impeller 1031 is entered from the first rear air inlet 10312 of the front impeller 1031. There is no second rear air inlet provided in the rear end surface of the rear impeller 1032, all of the wind for the rear impeller 1032 is entered from the second front air inlet 10321 of the rear impeller 1032.

After the air with exhaust fumes enters from the left air inlet 1011 and the right air inlet, a part of the wind is sucked from the first rear air inlet 10312 of the front impeller 1031, and the remaining air with exhaust fumes is sucked from the second front air inlet 10321 of the rear impeller 1032. Therefore, the exhausting path of the air with exhaust fumes is greatly reduced without changing the distance between the front plate and the rear plate of the microwave oven, the air suction efficiency of the left fan 103 and the right fan is extremely improved, and then the efficiency of sucking the exhaust fumes for the microwave oven 10 is greatly improved.

Furthermore, since there is a larger distance between the front impeller 1031 and the driving motor 1033, and a larger distance between the rear impeller 1032 and the driving motor 1033, more air with exhaust fumes can be passed though the driving motor, so that the cooling effect for the driving motor 1033 is extremely improved. That is, the driving motor 1033 can be cooled down by the air sucked from the first rear air inlet 10312 of the front impeller 1031. Furthermore, the driving motor 1033 also can be cooled down by the air sucked from the second front air inlet 10321 of the rear impeller 1032.

Advantageously, the left air inlet 1011 and the right air inlet are located in the middle of the bottom wall of the receiving chamber 1013. In other words, the left air inlet 1011 and the right air inlet are provided in the middle of the bottom plate 1016. The left air inlet 1011 and the right air inlet are opposed to the first rear air inlet 10312 of the front impeller 1031 and the second front air inlet 10321 of the rear impeller 1032. Thus, the exhausting path of the air with exhaust fumes is greatly reduced without changing the distance between the front plate and the rear plate of the microwave oven 10, and the air suction efficiency of the left fan 103 and the right fan is extremely improved, and then the efficiency of sucking the exhaust fumes for the microwave oven 10 is greatly improved.

The fifth predetermined distance H5 may equal to the sixth predetermined distance H6, so that the configuration of the microwave oven 10 may be more reasonable.

Those skills in the art may understand that the arrangement for the front impeller 1031 and the rear impeller 1032 of the left fan 103 may be different from the front impeller 1031 and the rear impeller 1032 of the right fan. For example, the front impeller 1031 and the rear impeller 1032 of the left fan 103 may be configured based on the structure described in the first embodiment, and the front impeller 1031 and the rear impeller 1032 of the right fan 103 may be configured based on the structure described in the second embodiment.

In the specification, unless specified or limited otherwise, relative terms such as "center", "longitudinal", "transverse" "length", "width", "thickness", "up", "down", "front", "rear", "left", "right", "vertical", "horizontal", "top", "bottom", "inner", "outer", "clockwise", "counterclockwise", "axial", "radial", "circumferential" as well as derivative thereof should be construed to refer to the orientation as then described or as shown in the drawings under discussion for simplifying the description of the present invention, but do not alone indicate or imply that the device or element referred to must have a particular orientation, and be constructed or operated in a particular orientation. Thus, these terms shall not be construed to limit the present invention.

Furthermore, in the specification, unless specified or limited otherwise, relative terms such as "first", "second" are only used for describing purpose, but do not alone indicate or imply that the device or element referred to must have a particular number. Thus, these terms shall not be construed to limit the present invention; the features limited with "first', "second" may include at least one of such feature. In the description of the present invention, "a plurality of" may indicated at least two, for example two, three and so on, unless specified or limited otherwise.

In the description of the present invention, unless specified or limited otherwise, it should be noted that, terms "installed," "connected" and "coupled" may be understood broadly, such as permanent connection or detachable connection, electronic connection or mechanical connection, direct connection or indirect connection via intermediary, inner communication or interreaction between two elements. These having ordinary skills in the art should understand the specific meanings in the present invention according to specific situations.

In the description of the present invention, unless specified or limited otherwise, it should be noted that, the first feature being "on" or "under" the second feature may be understood broadly, the first feature can be directly contact with the second feature or indirectly contact with the second feature via a middle medium. Also, the first feature being "on", "above" and "over" the second feature may be understood that the first feature is located "right" or "obliquely" above the second feature, or only the level of the first feature is higher than the second feature. The first feature being "under", "below" and "underneath" the second feature may be understood that the first feature is located "right" or "obliquely" below the second feature, or only the level of the first feature is lower than the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A microwave oven comprising:

a housing having a receiving chamber therein, a left air inlet and a right air inlet being provided at a bottom portion of the housing and an air outlet being provided in the housing;

an inner case provided in said receiving chamber, a left air channel being formed between a left side wall of said receiving chamber and a left side of said inner case and being in communication with said left air inlet and said air outlet of the housing, a right air channel being formed between a right side wall of said receiving chamber and a right side of said inner case and being in communication with said right air inlet and said air outlet of the housing; and a left fan and a right fan, said left fan being provided in the left air channel and said right fan being provided in the right air channel, the left fan and the right fan each including a front impeller, a rear impeller and a driving motor, wherein at least one of the front impeller and the rear impeller is adjacent to at least one of a front wall and a rear wall of said receiving chamber which is corresponding thereto, said at least one of the front impeller and the rear impeller is spaced from the driving motor at a predetermined distance, wherein the left fan is configured so that air entering from the left air inlet passes over the driving motor of the left fan, and the right fan is configured so that air entering from the right air inlet passes over the driving motor of the right fan.

2. The microwave oven according to claim 1, wherein said front impeller is spaced from said front wall of the receiving chamber at a first predetermined distance, said rear impeller is adjacent to said rear wall of the receiving chamber, said rear impeller is spaced from said driving motor at a second predetermined distance, wherein a first front air inlet is provided in a front end surface of the front impeller, and a first rear air inlet is provided in a rear end surface of the front impeller, a second front air inlet is provided in a front end surface of the rear impeller.

3. The microwave oven according to claim 2, wherein said left air inlet and said right air inlet are adjacent to said front wall of the receiving chamber.

4. The microwave oven according to claim 1, wherein said front impeller is adjacent to the front all of the receiving chamber, said front impeller is spaced from said driving motor at a third predetermined distance, said rear impeller is spaced from said rear wall of the receiving chamber at a fourth predetermined distance, wherein a first rear air inlet is provided in a rear end surface of the front impeller, a second front air inlet is provided in a front end surface of the rear impeller, and a second rear air inlet is provided in a rear end surface of the rear impeller.

5. The microwave oven according to claim 4, wherein said left air inlet and said right air inlet are adjacent to the rear wall of said receiving chamber.

6. The microwave oven according to claim 1, wherein said front impeller is adjacent to the front wall of said receiving chamber, said front impeller is spaced from said driving motor at a fifth predetermined distance, said rear impeller is adjacent to the rear wall of said receiving chamber, said rear impeller is spaced from said driving motor at a sixth predetermined distance, wherein a first rear air inlet is provided in a rear end surface of the front impeller, and a second front air inlet is provided in a front end surface of the rear impeller.

7. The microwave oven according to claim 6, wherein said left air inlet and said right air inlet are located in the middle of the bottom portion of the receiving chamber, said left air inlet and said right air inlet are faced to the first rear air inlet of the front impeller and the second front air inlet of the rear impeller.

8. The microwave oven according to claim 6, wherein said fifth predetermined distance is equal to said sixth predetermined distance.

9. The microwave oven according to claim 1, wherein said housing includes a bottom plate, a top plate, and a front plate, a rear plate, a left side plate and a right side plate which are provided on said bottom plate and said top plate, wherein the left air inlet and the right air inlet of the housing are provided in said bottom plate, said air outlet of the housing is provided in at least one of said top plate, said front plate and said rear plate.

10. The microwave oven according to claim 2, wherein said housing includes a bottom plate, a top plate, and a front plate, a rear plate, a left side plate and a right side plate which are provided on said bottom plate and said top plate, wherein the left air inlet and the right air inlet of the housing are provided in said bottom plate, said air outlet of the housing is provided in at least one of said top plate, said front plate and said rear plate.

11. The microwave oven according to claim 3, wherein said housing includes a bottom plate, a top plate, and a front plate, a rear plate, a left side plate and a right side plate which are provided on said bottom plate and said top plate, wherein the left air inlet and the right air inlet of the housing are provided in said bottom plate, said air outlet of the housing is provided in at least one of said top plate, said front plate and said rear plate.

12. The microwave oven according to claim 4, wherein said housing includes a bottom plate, a top plate, and a front plate, a rear plate, a left side plate and a right side plate which are provided on said bottom plate and said top plate, wherein the left air inlet and the right air inlet of the housing are provided in said bottom plate, said air outlet of the housing is provided in at least one of said top plate, said front plate and said rear plate.

13. The microwave oven according to claim 5, wherein said housing includes a bottom plate, a top plate, and a front plate, a rear plate, a left side plate and a right side plate which are provided on said bottom plate and said top plate, wherein the left air inlet and the right air inlet of the housing are provided in said bottom plate, said air outlet of the housing is provided in at least one of said top plate, said front plate and said rear plate.

14. The microwave oven according to claim 6, wherein said housing includes a bottom plate, a top plate, and a front plate, a rear plate, a left side plate and a right side plate which are provided on said bottom plate and said top plate, wherein the left air inlet and the right air inlet of the housing are provided in said bottom plate, said air outlet of the housing is provided in at least one of said top plate, said front plate and said rear plate.

15. The microwave oven according to claim 7, wherein said housing includes a bottom plate, a top plate, and a front plate, a rear plate, a left side plate and a right side plate which are provided on said bottom plate and said top plate, wherein the left air inlet and the right air inlet of the housing are provided in said bottom plate, said air outlet of the housing is provided in at least one of said top plate, said front plate and said rear plate.

16. A microwave oven, comprising:

a housing having a receiving chamber therein, a left air inlet and a right air inlet being provided at a bottom portion of the housing and an air outlet being provided in the housing;

an inner case provided in said receiving chamber, a left air channel being formed between a left side wall of said receiving chamber and a left side of said inner case and being in communication with said left air inlet and said air outlet of the housing, a right air channel being formed between a right side wall of said receiving chamber and a right side of said inner case and being in communication with said right air inlet and said air outlet of the housing; and a left fan and a right fan, said left fan being provided in the left air channel and said right fan being provided in the right air channel, the left fan and the right fan each including a front impeller, a rear impeller and a driving motor, wherein at least one of the front impeller and the rear impeller is adjacent to at least one of a front wall and a rear wall of said receiving chamber which is corresponding thereto, said at least one of the front impeller and the rear impeller is spaced from the driving motor at a predetermined distance;

wherein said front impeller is spaced from said front wall of the receiving chamber at a first predetermined distance, said rear impeller is adjacent to said rear wall of the receiving chamber, said rear impeller is spaced from said driving motor at a second predetermined distance, wherein a first front air inlet is provided in a front end surface of the front impeller, and a first rear air inlet is provided in a rear end surface of the front impeller, a second front air inlet is provided in a front end surface of the rear impeller, said left air inlet and said right air inlet are adjacent to said front wall of the receiving chamber.

17. A microwave oven, comprising:

a housing having a receiving chamber therein, a left air inlet and a right air inlet being provided at a bottom portion of the housing and an air outlet being provided in the housing;

an inner case provided in said receiving chamber, a left air channel being formed between a left side wall of said receiving chamber and a left side of said inner case and being in communication with said left air inlet and said air outlet of the housing, a right air channel being formed between a right side wall of said receiving chamber and a right side of said inner case and being in communication with said right air inlet and said air outlet of the housing; and a left fan and a right fan, said left fan being provided in the left air channel and said right fan being provided in the right air channel, the left fan and the right fan each including a front impeller, a rear impeller and a driving motor, wherein at least one of the front impeller and the rear impeller is adjacent to at least one of a front wall and a rear wall of said receiving chamber which is corresponding thereto, said at least one of the front impeller and the rear impeller is spaced from the driving motor at a predetermined distance;

said front impeller is adjacent to the front all of the receiving chamber, said front impeller is spaced from said driving motor at a third predetermined distance, said rear impeller is spaced from said rear wall of the receiving chamber at a fourth predetermined distance, wherein a first rear air inlet is provided in a rear end surface of the front impeller, a second front air inlet is provided in a front end surface of the rear impeller, and a second rear air inlet is provided in a rear end surface of the rear impeller;

said left air inlet and said right air inlet are adjacent to the rear wall of said receiving chamber.

* * * * *